US006843777B2

(12) United States Patent
Togno

(10) Patent No.: US 6,843,777 B2
(45) Date of Patent: Jan. 18, 2005

(54) HYDRAULIC MASSAGER DEVICE

(75) Inventor: Franco Togno, Casale Corte Cerro (IT)

(73) Assignee: I.M.P.A. F.LLI Togno S.r.l., Verbania Fondotoce (IT)

( * ) Notice: Subject to any disclaimer, the term of this patent is extended or adjusted under 35 U.S.C. 154(b) by 196 days.

(21) Appl. No.: 10/180,056

(22) Filed: Jun. 27, 2002

(65) Prior Publication Data

US 2003/0023194 A1 Jan. 30, 2003

(30) Foreign Application Priority Data

Jun. 28, 2001 (EP) ..... 01830439

(51) Int. Cl.[7] ..... A61H 23/04
(52) U.S. Cl. ..... 601/55; 601/72; 601/75
(58) Field of Search ..... 601/55, 60, 67, 601/69, 72, 73, 75, 88, 96, 105, 112, 154, 155, 160, 161; 4/541.1–541.5; 239/383, 447, 449

(56) References Cited

U.S. PATENT DOCUMENTS 890,709 A * 6/1908 Richwood ..... 601/75
1,861,924 A * 6/1932 Karlstrom et al. ..... 601/75
2,905,171 A 9/1959 De Crescenzo
3,924,808 A * 12/1975 Cooley, Jr. ..... 601/155
3,968,789 A 7/1976 Simoncini
4,228,558 A 10/1980 Zhadanov
4,313,432 A * 2/1982 Sievers ..... 601/75
4,432,355 A 2/1984 Delluc
4,703,893 A * 11/1987 Gruber ..... 239/449
4,709,691 A 12/1987 Lemons et al.
5,070,864 A * 12/1991 Lemons ..... 601/160
5,385,532 A 1/1995 Shyu
5,467,927 A 11/1995 Lee
5,807,289 A * 9/1998 Camp ..... 601/160
5,902,258 A * 5/1999 Cziriak ..... 601/55

FOREIGN PATENT DOCUMENTS

JP 402218316 A * 8/1990 ..... A47K/3/22

* cited by examiner

*Primary Examiner*—Danton D. DeMille
*Assistant Examiner*—Quang D. Thanh
(74) *Attorney, Agent, or Firm*—Young & Thompson

(57) ABSTRACT

A massaging device that can be used to apply a powerful massaging action to any parts of the body according to necessity. The device includes a cylindrical body of given length and diameter, an eccentric weight rotating by a driving element within the cylindrical body, a handgrip coaxially extending to the cylindrical body, and a turbine mounted between the handgrip and the cylindrical body and forming the driving elements of the eccentric weight.

28 Claims, 2 Drawing Sheets

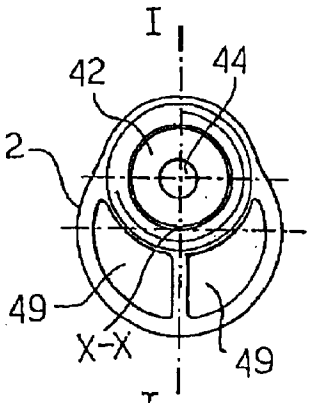
FIG. 3
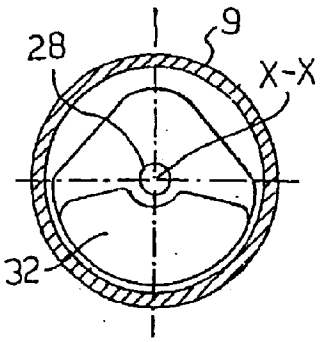
FIG. 4
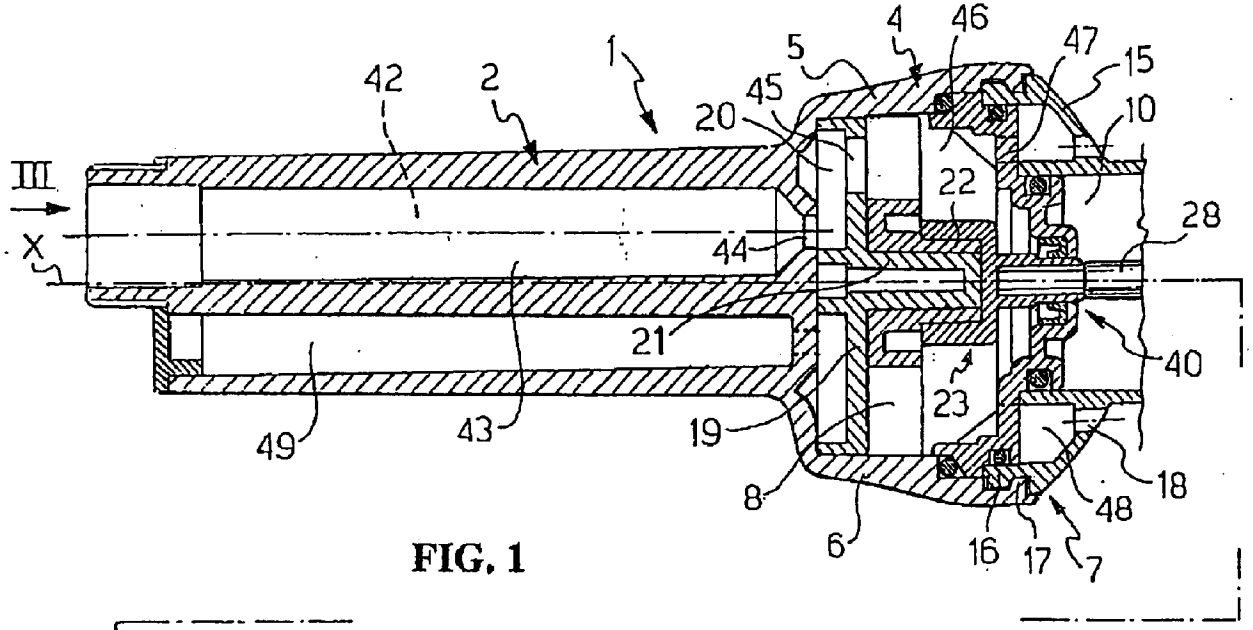
FIG. 1
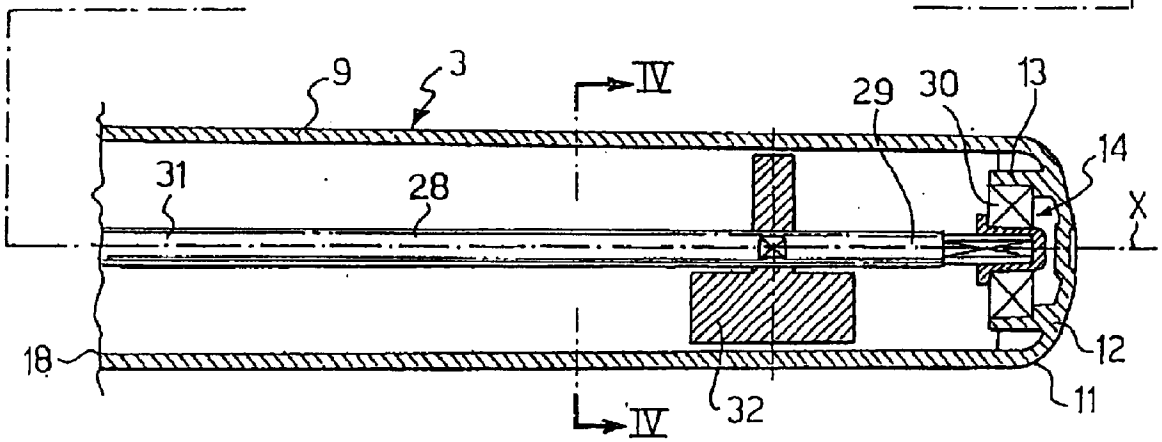

HYDRAULIC MASSAGER DEVICE

FIELD OF APPLICATION

The present invention relates to a massaging device operated by a working fluid for a powerful massaging action.

PRIOR ART

Known are massaging devices in which a cylindrical body is set into vibratory motion by a driving means rotating at least one eccentric weight. Also known is to have the eccentric weight driven by a turbine rotor which is operated by a working fluid, e.g. lukewarm to hot water, inside the cylinder body and functions as said driving means.

These prior devices are hard to manipulate, and are customarily associated with pillows and the like for treatment of the neck or cervix of the person to be massaged. Moreover, these are low-power devices since they can only accommodate a small turbine.

To provide a more powerful massaging action, it has been suggested of mounting the turbine on the exterior of the cylindrical body. However, this has worsen the capability of manipulating the device, e.g. when massaging different or farthest parts of the human body of the person to be massaged.

The aim of the present invention is that of providing a massaging device operated by a working fluid for a powerful massaging action and having suitable structural and functional features such to overcome the limitations of massaging devices according to the prior art.

SUMMARY OF THE INVENTION

The invention provides a massaging device comprising:

a cylindrical body of predetermined length and diameter;

an eccentric weight rotating by the action of a driving means;

a handgrip extending coaxially with the cylindrical body; and a turbine placed between the handgrip and the cylindrical body, said driving means for said eccentric weight including said turbine.

A further embodiment of the invention relates to a massaging device operated by a working fluid for a powerful massaging action, comprising:

a cylindrical body;

a handgrip extending coaxially with the cylindrical body;

a turbine driven by said working fluid and placed between the handgrip and the cylindrical body;

an eccentric weight driven by said turbine.

Further features and advantages of a massaging device according to this invention are set forth in the following description of a preferred embodiment thereof, given by way of non-limitative example with reference to the accompanying drawings.

BRIEF DESCRIPTION OF THE DRAWINGS

FIG. 1 shows a sectional view of a massaging device according to the present invention, taken along the line I—I.

FIG. 3 shows a cross-sectional view taken through the device of FIG. 1, taken along the line→III—III.

FIG. 4 shows a cross-sectional view taken through the device of FIG. 1, taken along the line IV—IV.

DETAILED DESCRIPTION

Figure 5:
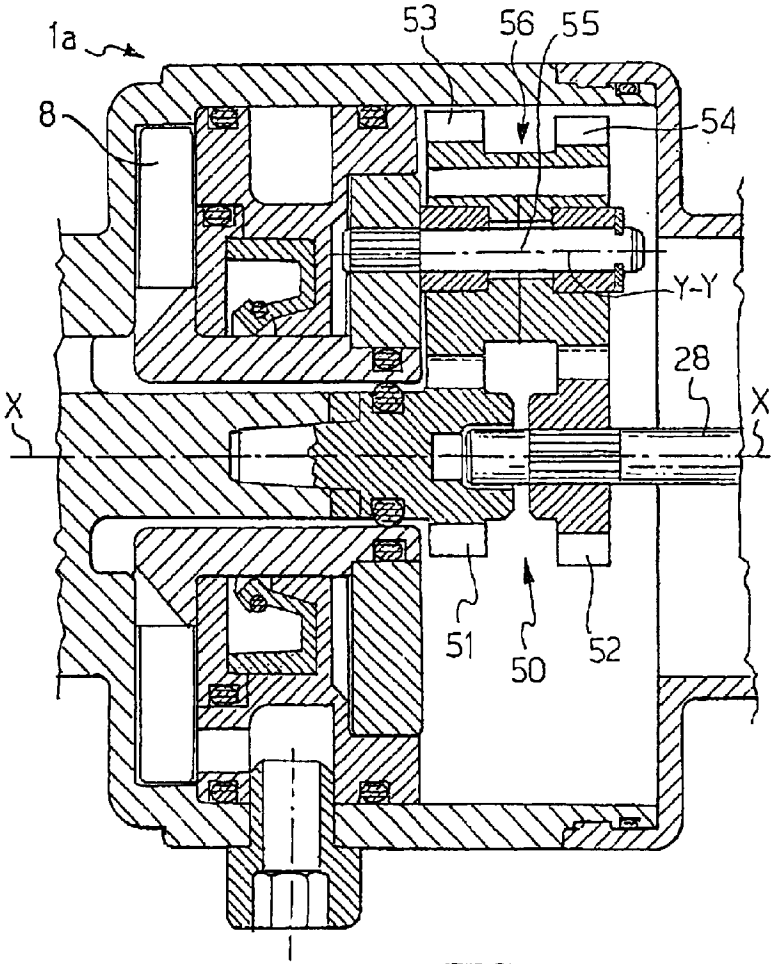
FIG. 5 shows a sectional view of a detail of the massaging device according to a modified embodiment of the present invention.
Figure 2:
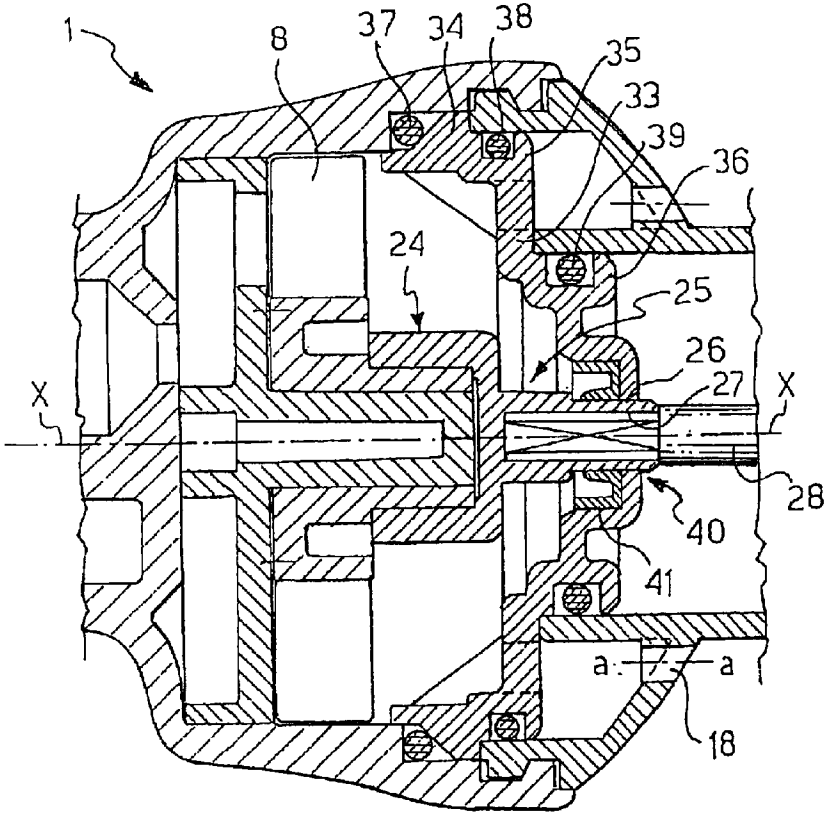
FIG. 2 shows a sectional view, drawn to an enlarged scale, of a detail of the massaging device shown in FIG. 1.

A massaging device according to this invention is generally shown at 1 with reference to the drawing views.

The massaging device 1 comprises a substantially cylindrical handgrip 2 having an axis x—x, and a cylindrical working portion 3 extending along the axis x—x. The working portion 3 is intended for application in pressure contact relationship against a body part to be massaged. A turbine 4 is mounted between the handgrip 2 and the working portion 3.

The turbine 4 comprises a case 5 consisting of a bell-shaped body 6 laid along the axis x—x, and a head piece, generally shown at 7, closing the bell-shaped body 6. The turbine 4 further comprises a turbine rotor 8, which is carried inside the case 5 for rotation about the axis x—x.

The bell-shaped body 6 is contiguous and integral with the handgrip 2, and is advantageously injection moulded out of a suitable plastics material, such as a nylon.

The head piece 7, to be described, is contiguous with the working portion 3.

The working portion 3 comprises a tubular body 9 approximately measuring 150 mm in length and 35 mm in diameter, which extends between an open end 10 facing the turbine 4 and a free end 11, the latter being closed by a bottom 12. The tubular body 9 as well as the bottom 12 are formed as integral pieces by injection moulding them out of a suitable plastics material, e.g. a nylon.

It should be noted that, inside the bottom portion of the tubular body 9, a tubular boss 13 is integrally formed with the bottom 12 to provide a ball bearing block 14. Furthermore, an annular skirt 15, radially jutting outwards towards the handgrip, is formed on the exterior of the tubular body 9 integrally with it and on the same side as the open end 10. The annular skirt 15 has a plug-in coupling means 16 for quick engagement with a mating coupling means 17 provided on the bell-shaped body 6. Thus, the tubular body 9 and the handgrip 2 can be assembled for manipulation as a unit.

The annular skirt 15 is provided with girdling holes, collectively designated 18, which extend along equidistant axes a-a lying parallel to axis x—x.

A disk 19, formed with an annular recess 20 open to the handgrip 2, and with a hub 21 facing the working portion 3, is force fitted into the bell-shaped body 6 thereby abutting the handgrip 2. The rotor 8 is journalled on the hub 21. The rotor 8 is formed with a hub 22 having a hexagonal shape and facing the working portion 3.

Shown at 23 is a bell-and-spigot joint having a bell part 24 with a internal hexagonal cross-section for keyed engagement on the hub 22, and a spigot part 25 having a cylindrical outer shroud 26 and a socket 27 with a hexagonal cross-section.

The working portion 3 includes a shaft 28 made preferably of metal (in the example, a stainless steel). The shaft 28 has one end 29 carried in a bearing 30 mounted in the bearing block 14, and has the other end 31 having to a hexagonal cross-sectional shape for keyed engagement in the hexagonal socket 27. Thus, the rotor 8 is connected drivingly to the shaft 28 through the bell-and-spigot joint 23.

A weight piece 32 having an offset center of gravity from the axis x—x to provide unbalance is keyed onto the shaft 28, preferably unitized by moulding on, for rotation therewith. The weight piece 32 is made of a high density material such as filled plastics.

The turbine 4 is a driving means fluid powered—preferably water, possibly lukewarm to hot—to jointly rotate the shaft 28 and the offset weight piece 32 and create vibration that localizes mainly in the area of the working portion 3 of the massaging device 1.

It should be noted that the case head piece 7 closing the bell-shaped body 6 comprises a disk 33 that mounts seals on three cylindrical outer portions 34, 35 and 36—in the example, O-Rings 37, 38 and 39, respectively—to provide tight joints true to the bell-shaped body 6, the skirt 15, and the tubular body 9, respectively. Inside the disk 33 there is a bore 40 for mounting the cylindrical shroud 26 of the part 25 of joint 23 rotatably therein. A lip seal 41 would be provided in this area.

The turbine 4 is fed with fluid, in particular water lukewarm to hot, through a feed conduit 42 comprising a section 43 that coaxially extends through the handgrip 2 therewith, a passage 44 extending through the bell-shaped body 6 and open into the recess 20, and a delivery nozzle 45 open to the rotor periphery. A fluid outlet conduit 46 is split into a plurality of holes 47 laid in a circle having a slightly larger diameter than a diameter of the cylindrical body. The fluid outlet conduit 46 leads, through the bell-shaped body 6 and the holes 47 formed in the disk 33, into an annular chamber 48 formed under the skirt 15, and then out to the part being massaged through the girdling holes 18, along the axis x—x.

Alternatively, it should be noted that the outlet conduit may include a return leg along the handgrip 2 in the form of a conduit section 49 lying parallel to the section 43. In this case, the disk 33 would be solid, i.e. have no holes 47 therein.

A modified embodiment of the inventive massaging device will now be described with reference to FIG. 5.

In FIG. 5, those parts of the massaging device which are the same or similar constructions or serve the same or similar functions as in the previously described device carry the same reference numerals and will be no further described.

In this embodiment, the rotor 8 drives the shaft 28, carrying the offset weight, through a reduction gear or gear train 50.

The reduction gear 50 is a planetary system comprising: a gear wheel 51, which is centered on the axis x—x and fastened with the handgrip; a gear wheel 52, which is centered on the axis x—x and keyed on the shaft that carries the eccentric weight; and a gear wheel train 53 and 54, wherein the gear wheels are coaxial and made fast together along a parallel axis y—y to the axis x—x for idle rotation about a stub shaft 55 on a spider 56, the latter being rigid with the turbine rotor. The number of teeth on the gear wheels 51, 52 and 53, 54 will be selected to provide a desired step-down ratio of the turbine rotor to the eccentric weight.

In operation, pressurized water impinging on the turbine will excite it into rotary motion and then leave the device through the outlet conduit. The turbine rotor transfers the angular movement to the shaft that carries the offset weight, either directly through the joint or indirectly through the reduction gear. The shaft RPM, and with it the frequency of the massaging action, can be easily varied by controlling the water flow rate.

As a result it is obtained a powerful massaging action where the tubular body is located and, precisely, where the device active or massaging portion is located, and due to the centrifugal force caused by the offset weight.

It should be noted that the water outflow from the outlet conduit of the massaging device will sweep across the part being massaged for enhanced massaging and soothing effect.

A major advantage of the massaging device according to this invention is that a powerful massaging action can be achieved at the same time as the massaging action is most conveniently localized on a desired part whatever of the body, especially a part affected by cellulitis.

Another advantage of the massaging device according to this invention is that the massage can be applied at high vibratory frequencies, by virtue of the eccentric weight being drivable at a high rotational speed by water flow control.

Also noteworthy is the simple construction of this massaging device made for durable and reliable maintenance-free performance.

This device is handled as a self-contained unit, and can be used to implement any bathroom, Turkish bath and similar, along with or in lieu of other standard appliances therein.

Lastly, it should be noted that this device can be manufactured out of non-toxic plastics materials using automated methods, no mean advantage for an article intended for mass production and retail sale.

Finally, this device can be made into an aesthetically pleasing shape to enhance its surroundings.

It should be understood that, in order to fill individual demands, the skilled person in the art may make changes and modifications unto the massaging devices described hereinabove as encompassed by the protection scope of this invention arising from the following claims.

What is claimed is:

1. A massaging device comprising:

a cylindrical body of predetermined length and diameter;

an eccentric weight located inside the cylindrical body rotating by the action of a driving means located outside the cylindrical body;

a handgrip extending coaxially with the cylindrical body; and a turbine placed between the handgrip and the cylindrical body, said driving means for said eccentric weight including said turbine.

2. A massaging device according to claim 1, wherein a feed conduit is provided extending along the handgrip for feeding pressurized water to the turbine.

3. A massaging device according to claim 2, wherein an outlet conduit for the water turbine is provided leading axially towards the cylindrical body.

4. A massaging device according to claim 3, wherein said outlet conduit is split into a plurality of holes laid in a circle having a slightly larger diameter than the one of the cylindrical body.

5. A massaging device according to claim 2, wherein a water outlet conduit of the turbine is provided extending along the handgrip of the device.

6. A massaging device according to claim 2, wherein the turbine comprises a case formed by a bell-shaped body integral with the device handgrip and a head piece held down by the cylindrical body.

7. A massaging device according to claim 6, wherein a means is provided for quickly coupling said bell-shaped body to the cylindrical body.

8. A massaging device according to claim 7, wherein said means is a plug-in coupling means.

9. A massaging device according to claim 2, wherein a reduction gear is provided between the rotor and the eccentric weight to step down the angular velocity of the eccentric weight with respect to the angular velocity of the rotor.

10. A massaging device operated by a working fluid for a powerful massaging action, comprising:

a cylindrical body;

a handgrip extending coaxially with the cylindrical body;

a turbine driven by said working fluid and placed outside the cylindrical body between the handgrip and the cylindrical body; and an eccentric weight located inside the cylindrical body driven by said turbine.

11. A massaging device according to claim 10, wherein a feed conduit is provided extending along the handgrip for feeding pressurized water to the turbine.

12. A massaging device according to claim 11, wherein a outlet conduit for the water turbine is provided leading axially towards the cylindrical body.

13. A massaging device according to claim 12, wherein said outlet conduit is split into a plurality of holes laid in a circle having a slightly larger diameter than the one of the cylindrical body.

14. A massaging device according to claim 11, wherein a water outlet conduit of the turbine is provided extending along the handgrip of the device.

15. A massaging device according to claim 11, wherein the turbine comprises a case formed by a bell-shaped body integral with the device handgrip and a head piece held down by the cylindrical body.

16. A massaging device according to claim 15, wherein a means is provided for quickly coupling said bell-shaped body to the cylindrical body.

17. A massaging device according to claim 16, wherein said means is a plug-in coupling means.

18. A massaging device according to claim 11, wherein a reduction gear is provided between the rotor and the eccentric weight to step down the angular velocity of the eccentric weight with respect to the angular velocity of the rotor.

19. A massaging device operated by a working fluid for a powerful massaging action comprising:

a cylindrical body of predetermined length and diameter;

an eccentric weight located inside the cylindrical body rotating by the action of a turbine located outside the cylindrical body; and a handgrip extending coaxially with the cylindrical body, said turbine being placed between the handgrip and the cylindrical body and being driven by said working fluid.

20. A massaging device according to claim 19, wherein a feed conduit is provided extending along the handgrip for feeding pressurized water to the turbine.

21. A massaging device according to claim 20, wherein a outlet conduit for the water turbine is provided leading axially towards the cylindrical body.

22. A massaging device according to claim 21, wherein said outlet conduit is split into a plurality of holes laid in a circle having a slightly larger diameter than the one of the cylindrical body.

23. A massaging device according to claim 21, wherein a water outlet conduit of the turbine is provided extending along the handgrip of the device.

24. A massaging device according to claim 20, wherein the turbine comprises a case formed by a bell-shaped body integral with the device handgrip and a head piece held down by the cylindrical body.

25. A massaging device according to claim 24, wherein a means is provided for quickly coupling said bell-shaped body to the cylindrical body.

26. A massaging device according to claim 25, wherein said means is a plug-in coupling means.

27. A massaging device according to claim 20, wherein a reduction gear is provided between the rotor and the eccentric weight to step down the angular velocity of the eccentric weight with respect to the angular velocity of the rotor.

28. The massaging device according to claim 19, wherein the turbine is coaxial with said handgrip and said cylindrical body.

* * * * *